US006244881B1

(12) United States Patent
Hara

(10) Patent No.: US 6,244,881 B1
(45) Date of Patent: Jun. 12, 2001

(54) CONNECTOR, DATA PROCESSING APPARATUS, AND NETWORK APPARATUS

(75) Inventor: Hideki Hara, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/137,992

(22) Filed: Aug. 21, 1998

(30) Foreign Application Priority Data

Sep. 3, 1997 (JP) ..... 9-238679

(51) Int. Cl.[7] ..... H01R 29/00
(52) U.S. Cl. ..... 439/188; 439/61
(58) Field of Search ..... 439/188, 61, 637; 361/788

(56) References Cited

U.S. PATENT DOCUMENTS

| | | | | |
|---|---|---|---|---|
| 3,976,850 | * | 8/1976 | Faber et al. | 439/188 |
| 4,087,151 | * | 5/1978 | Robert et al. | 439/188 |
| 4,106,841 | * | 8/1978 | Vladic | 439/188 |
| 4,285,565 | * | 8/1981 | Kirby | 439/637 |
| 4,514,030 | * | 4/1985 | Triner et al. | 439/637 |
| 5,277,607 | * | 1/1994 | Thumma et al. | 439/637 |
| 5,286,215 | * | 2/1994 | Dewey et al. | 439/188 |
| 5,533,907 | * | 7/1996 | Kozel et al. | 439/188 |

* cited by examiner

*Primary Examiner*—Paula Bradley
*Assistant Examiner*—Tho D. Ta
(74) *Attorney, Agent, or Firm*—Lerner, David, Littenberg, Krumholz & Mentlik, LLP

(57) ABSTRACT

The present invention provides a network apparatus for a network of ring topology configuration in which an insertion of an I/O card automatically ring-connects the I/O card and a removal of the I/O card automatically leaves the empty position ring-connected. A connector 1 which is ring-connected to a network includes connection means to be inserted to intervene a signal line. The connection means has a first terminal member and a second connection member. In a first state of the connection means, the first terminal member is in contact with the second terminal member so as to establish an electrical connection between the first terminal member and the second terminal member. In a second state of the connection means, the first terminal member is mechanically disconnected from the second terminal member, which is associated with that the first terminal member is brought into contact with a first connection member of a node so as to establish an electrical connection between the first terminal member and the first connection member, and the second terminal member is brought into contact wint a second connection member of the node so as to establish an electrical connection between the second terminal member and the second connection member.

4 Claims, 13 Drawing Sheets

CONNECTOR, DATA PROCESSING APPARATUS, AND NETWORK APPARATUS

BACKGROUND OF THE INVENTION

Field of the Invention

The present invention relates to a connector to be connected to an object apparatus, a data processing apparatus for processing a signal inputted to a signal line, and a network apparatus constituted by a plurality of equipments connected.

Description of the Prior Art

Recently a network system capable of sharing an information signal has been suggested.

The network system, for example, employs a ring topology where a plurality of equipments are connected so that an input/output signal is in a single ring shape. Here, the ring topology represents a form or configuration of a network connection. The network system of this ring topology, in general, is a network system where equipments connected to the network, i.e., so-called nodes carry out a signal transmission and reception in a ring shape.

For example, in a network system of the aforementioned ring topology, as shown in FIG. 1, nodes serving as communication equipment are inserted/connected to the network so that a signal is transmitted and received in a ring shape between communication equipment serving as nodes.

Here, if a signal is passed between a node 101 and a node 103, a signal transmitted from the node 101 goes via a node 102 to the node 103. The signal processed by the node 103 goes vgia a node 104 to be received by the node 101.

Each of the aforementioned nodes has an input block and an output block for passing a signal. Each of the nodes receives a signal through the input block, process the signal in its own processing circuit, and outputs the signal from the output block. Among signals inputted to a node, there is such a signal that is outputted without being processed in that node.

Now, in the network system 100 employing the aforementioned ring topology, if one of the nodes is removed from the network, the input and the output in this node are left unconnected, and a signal cannot be transferred. Accordingly, it is necessary to make a connection for the removed node.

For example, as shown in FIG. 2, suppose the node 101 is removed. A signal to the other nodes 102, 103, and 104 are not connected and these nodes cannot operate. In this case, as shown in FIG. 3, a connection should be made between the node 104 the node 102 by some means.

The same applies to a data processing apparatus such as a computer serving as the aforementioned node. For example, as shown in FIG. 4, a data processing apparatus is constituted by a plurality of connectors 107, 108, 109, 110, and 111 which are arranged in series on a back plane substrate 106 constituting a back plane as an internal bus, and which are used for connection of an object apparatus to be connected such as I/O (input/output) card 105.

In the aforementioned data processing apparatus, a signal inputted is transmitted in one direction between the plurality of connectors 107, 108, 109, 110, and 111 which are connected in series on the back plane substrate 106. For example, in the connector 111, the signal is outputted via the I/O card 105 connected.

For example, when the aforementioned data processing apparatus is connected to a network using a ring topology, in order to maintain a ring connection in the entire network, even if an I/O card is mounted on the data processing apparatus, an I/O signal should be taken into the I/O card.

However, with a conventional connector, it is impossible to cut off an electrical connection and simultaneously take the I/O signal into the I/O card. Accordingly, with a conventional connector, it is impossible to insert or remove an I/O card while maintaining a ring topology.

Moreover, among connectors, there is such a connector that is constituted to cut off an electrical connection on the back plane and to be short-circuited by an adapter or the like. FIG. 5 to FIG. 7 show such examples.

FIG. 5 shows a specific example of the back plane substrate 106 on which the plurality of connectors 107, 108, 109, 119, and 111 are connected in series. Here, on the back plane substrate 106, the plurality of connectors 107, 108, 109, 110, and 111 are connected in series by six signal lines 112 In a case of a conventional connector, connection means 120 to be inserted/connected to respective signal lines is normally constituted so as to cut off an electrical connection. More specifically, the connection means 120 is constituted by terminal members 118 and 119 which are arranged apart when no I/O card is inserted, thus cutting off the electrical connection.

Accordingly, as shown in FIG. 6, in a conventional connector, a signal inputted is outputted via an I/O card 105 inserted and adapters 113, 114, 115, and 116. For example, the I/O card 105 inserted to the connector 111 processes in a processing circuit 117 a signal inputted via the connector 111, or outputs the signal as it is via the connector 111 without processing the signal. Moreover, the adapters 113, 114, 115, and 116 shortcut an input and output of the respective connectors 107, 108, 109, 110, and 111 so that a signal inputted is outputted as it is.

In other words, when the I/O card 105 or the adapters 113, 114, 115, and 116 are not inserted, the connectors 107, 108, 109, 110, and 111 cannot output a signal inputted. For example, as shown in FIG. 7, if no I/O card or adapter is inserted to the connectors 107, 108, 109, and 110, no signal is inputted to the I/O card 105 inserted into the connector 111.

Moreover, in a network system using a ring topology in which a data processing apparatus having a back plane of the aforementioned configuration is involved as a node, if a signal is cut off in the node as has been described above, it is impossible to maintain a ring connection in the network as a whole.

However, it is not desirable to insert an adapter for short-circuiting into all the empty connectors having no I/O card or the like.

SUMMARY OF THE INVENTION

It is therefore an object of the present invention to provide a connector and a data processing apparatus in which insert and removal of an I/O card or the like is carried out as follows: when an I/O card or the like is inserted, it is automatically connected to a signal line, and when the I/O card or the like is removed, the connection state of a back plane can be maintained.

Moreover, another object of the present invention is to provide a network apparatus for a ring topology type network, which apparatus operates as follows: when an I/O card or the like is inserted to a back plane, it is automatically ring-connected, and when the I/O card or the like is removed, the ring connection state can be maintained without using an adapter.

The connector according to the present invention includes connection means consisting of: a first terminal member to be electrically connected to a first connection member serving as a terminal of the object apparatus; and a second terminal member to be electrically connected to a second connection member serving as at terminal of the object apparatus, wherein in a first state, the first terminal member is in contact with the second terminal member to establish an electrical connection between the first terminal member and the second terminal member, and in a second state, the first terminal member is mechanically disconnected from the second terminal member, which is associated with that the first terminal member is brought into contact with the first connection member to establish an electrical connection between the first terminal member and the first connection member, and the second terminal member is brought into contact with the second connection member to establish an electrical connection between the second terminal member and the second connection member.

The data processing apparatus according to the present invention includes a connector having connection means connected to a signal line so that a terminal side of an object apparatus to be connected is guided to be inserted into the connection means, wherein the connection means includes: a first terminal member which is connected to intervene at least one signal line and which is electrically connected to a first connection member provided at the terminal side of the object apparatus; and a second terminal member to be electrically connected to a second connection member provided at the terminal side of the object apparatus, and wherein in a first state, the first terminal member is in contact with the second terminal member to establish an electrical connection between the first terminal member and the second terminal member; and in a second state, the first terminal member is mechanically disconnected from the second terminal member, which is associated with that the first terminal member is brought into contact with the first connection member to establish an electrical connection between the first terminal member and the first connection member, and the second terminal member is brought into contact with the second connection member to establish an electrical connection between the second terminal member and the second connection member.

The network apparatus according to the present invention includes a connector having connection means connected to a signal line to be connected to a network, so that a terminal side of an object apparatus to be connected to the network is guided to be inserted into the connection means, wherein connection means is provided including: a first terminal member to be electrically connected to a first connection member provided at the terminal side of the object apparatus; and a second terminal member to be electrically connected to a second connection member provided at the terminal side of the object apparatus, and wherein in a first state, the first terminal member is in contact with the second terminal member to establish an electrical connection between the first terminal member and the second terminal member, and in a second state, the first terminal member is mechanically disconnected from the second terminal member, which is associated with that the first terminal member is brought into contact with the first connection member to establish an electrical connection between the first terminal member and the first connection member, and the second terminal member is brought into contact with the second connection member to establish an electrical connection between the second terminal member and the second connection member.

DETAILED DESCRIPTION OF PREFERRED EMBODIMENTS

Description will now be directed to an embodiment of the present invention with reference to the attached drawings. A connector according to this embodiment is a connector which is electrically connected when an object apparatus such as an I/O card is detachably inserted/connected to a back plane constituting an interior. For example, the connector is constituted in a back plane of a computer or like connected to a network system of a ring topology.

Figure 1:
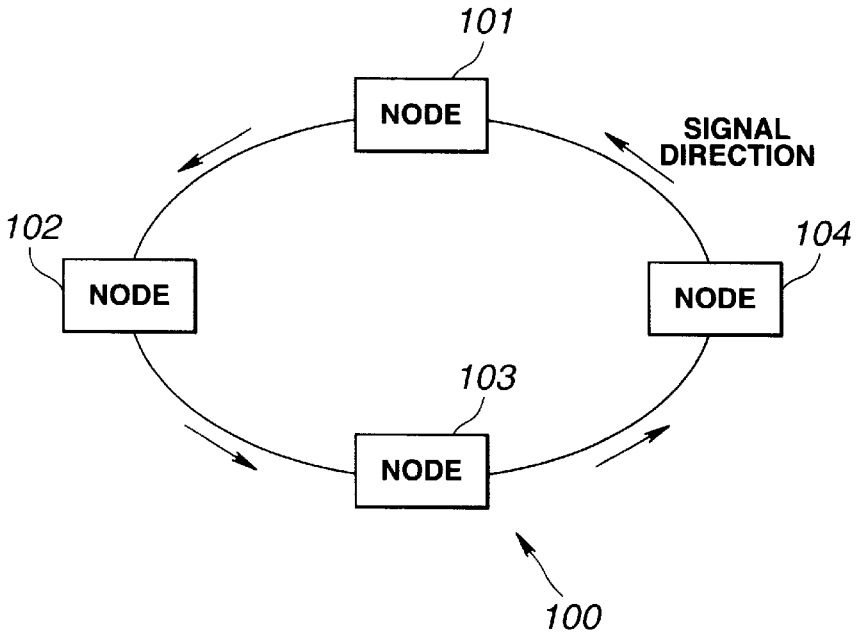
FIG.1 (PRIOR ART)
FIG. 1 shows a configuration of a network system constituted by a plurality of nodes by way of a ring topology.
Figure 2:
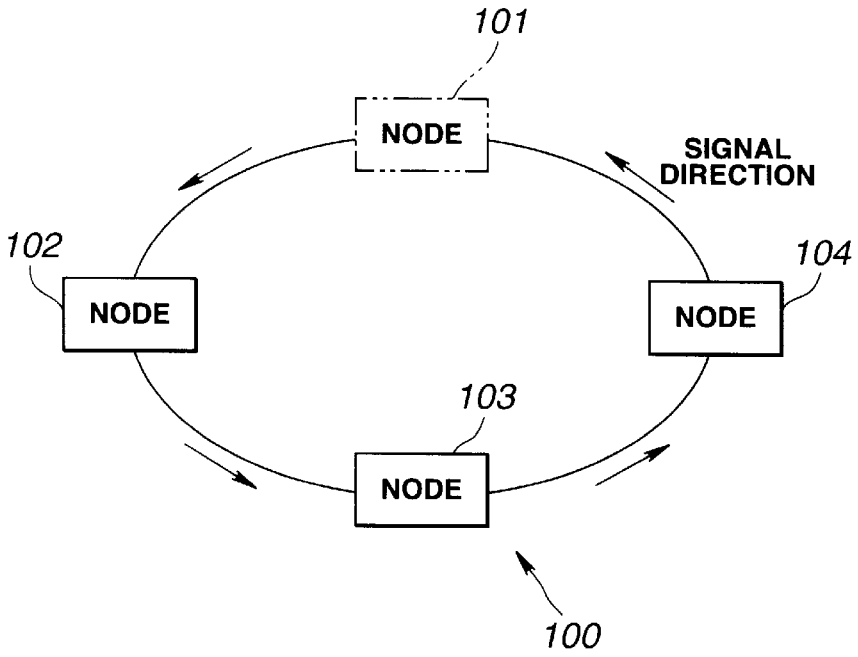
FIG.2 (PRIOR ART)
FIG. 2 shows a state when one of the nodes has been removed from the aforementioned network system constituted by way of the ring topology.
Figure 3:
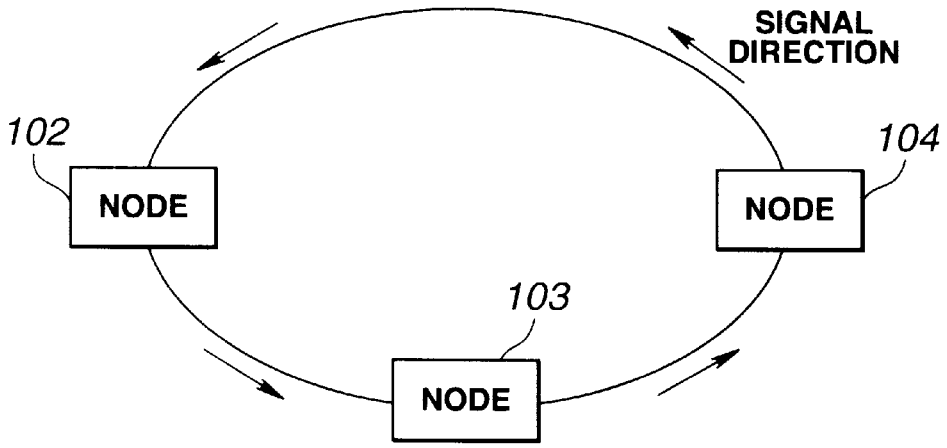
FIG.3 (PRIOR ART)
FIG. 3 shows a state when a position where one of the nodes has been removed is connected in the aforementioned network system constituted by way of the ring topology.
Figure 4:
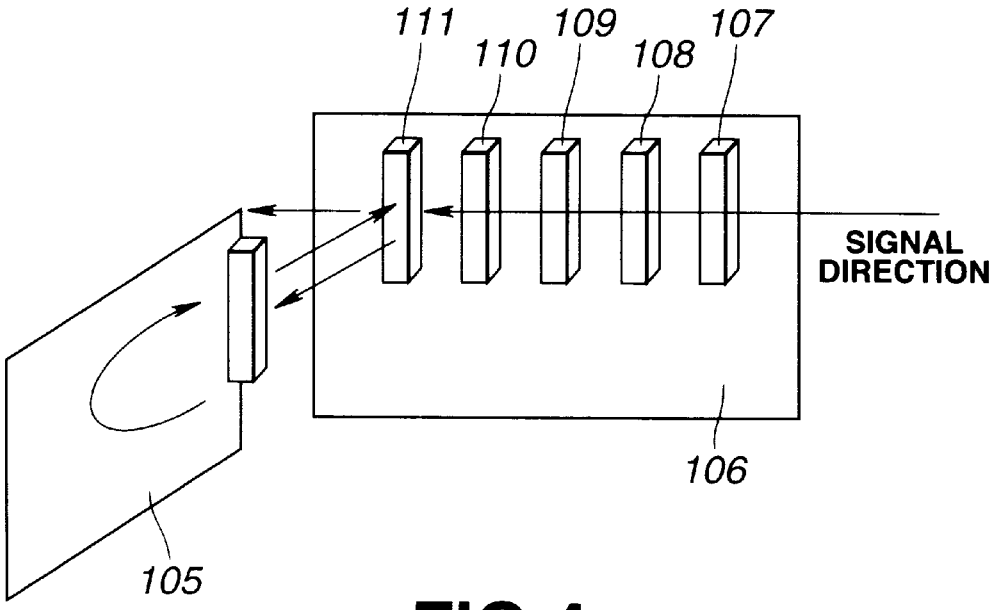
FIG.4 (PRIOR ART)
FIG. 4 explains insert and removal of an I/O card to/from a conventional connector constituted on a back plane of a computer.
Figure 5:
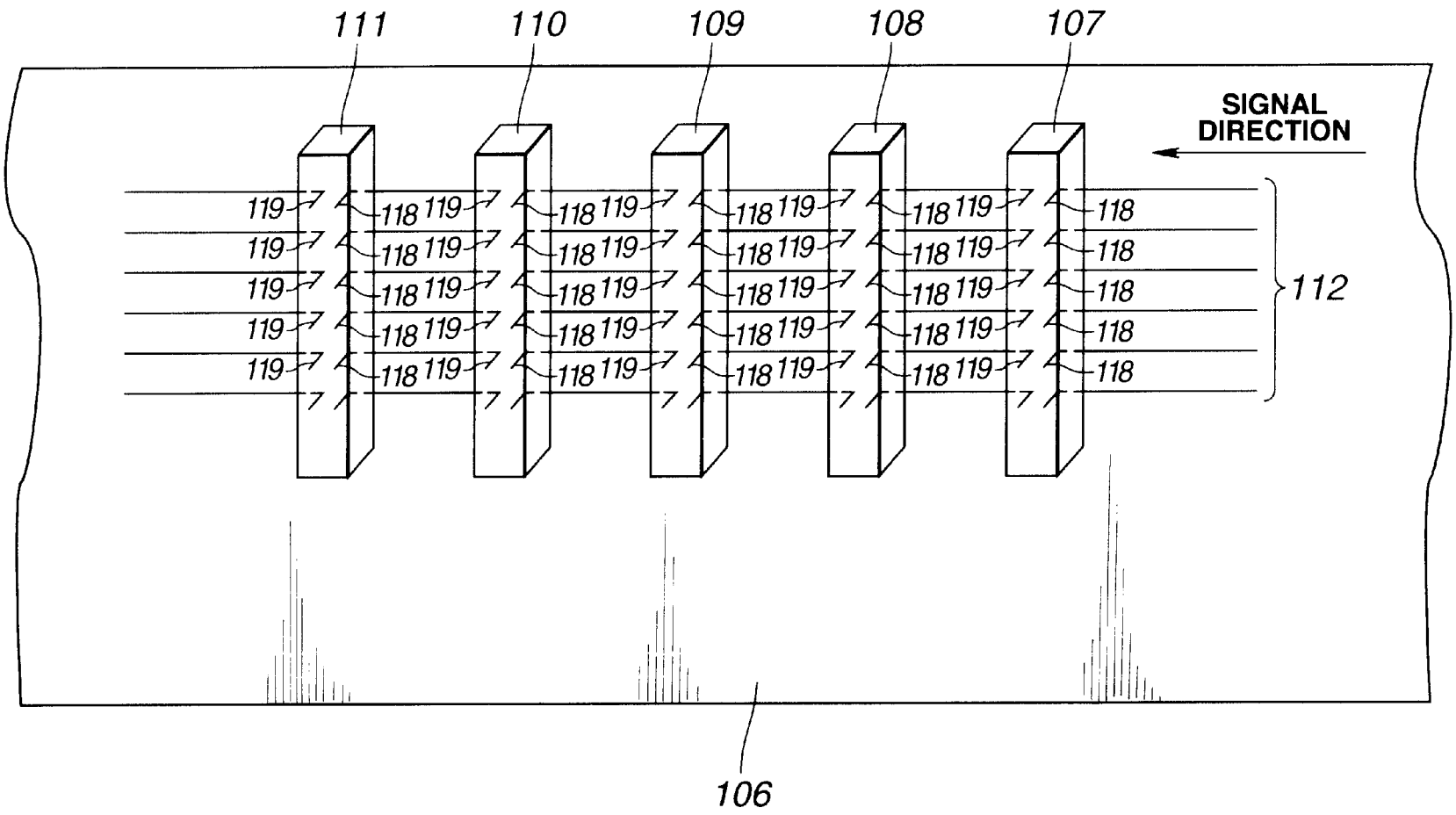
FIG.5 (PRIOR ART)
FIG. 5 is a perspective view showing a computer back plane constituted by a conventional connector.
Figure 6:
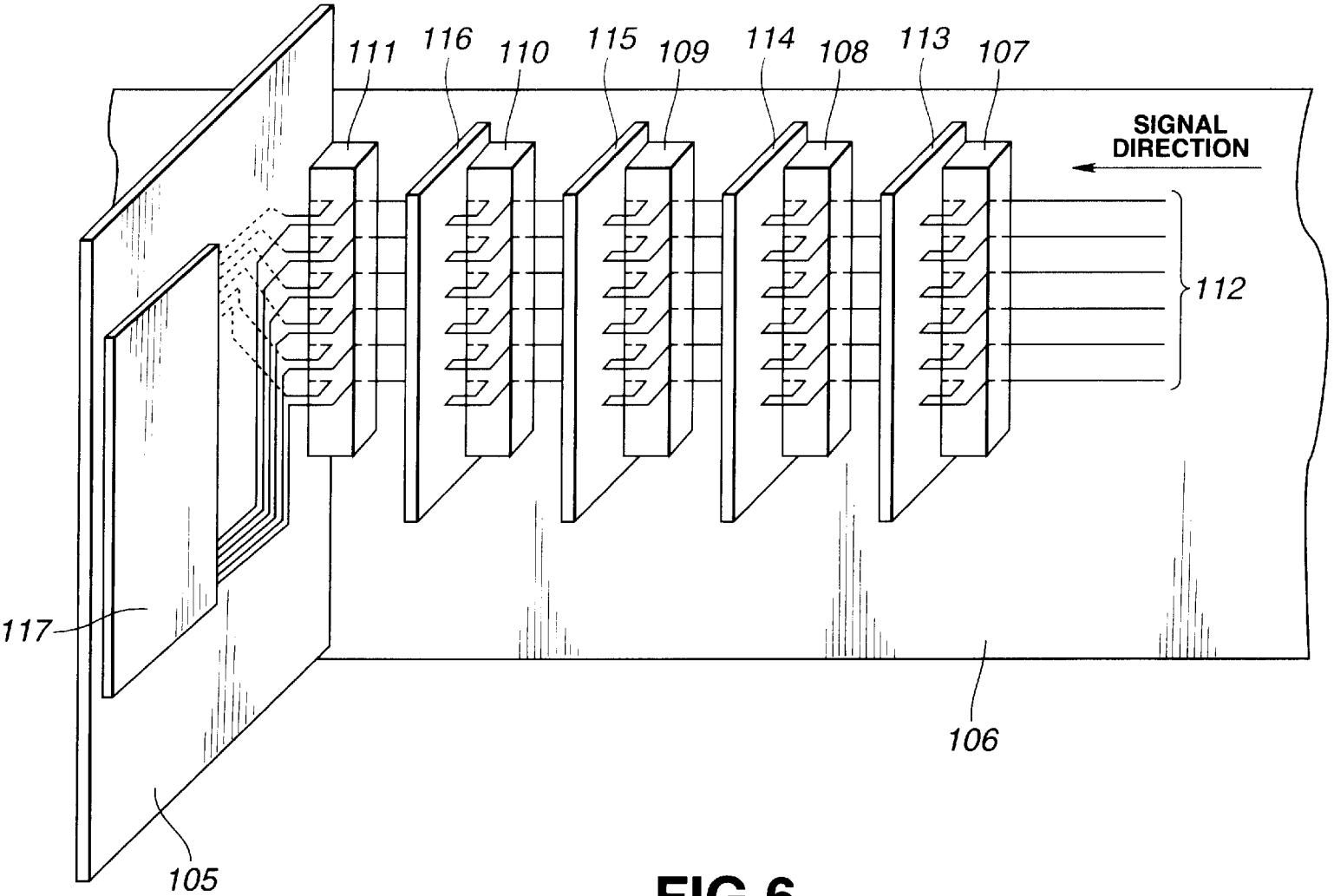
FIG.6 (PRIOR ART)
FIG. 6 shows an I/O card and a short-circuiting adapter inserted into a conventional connector.
Figure 7:
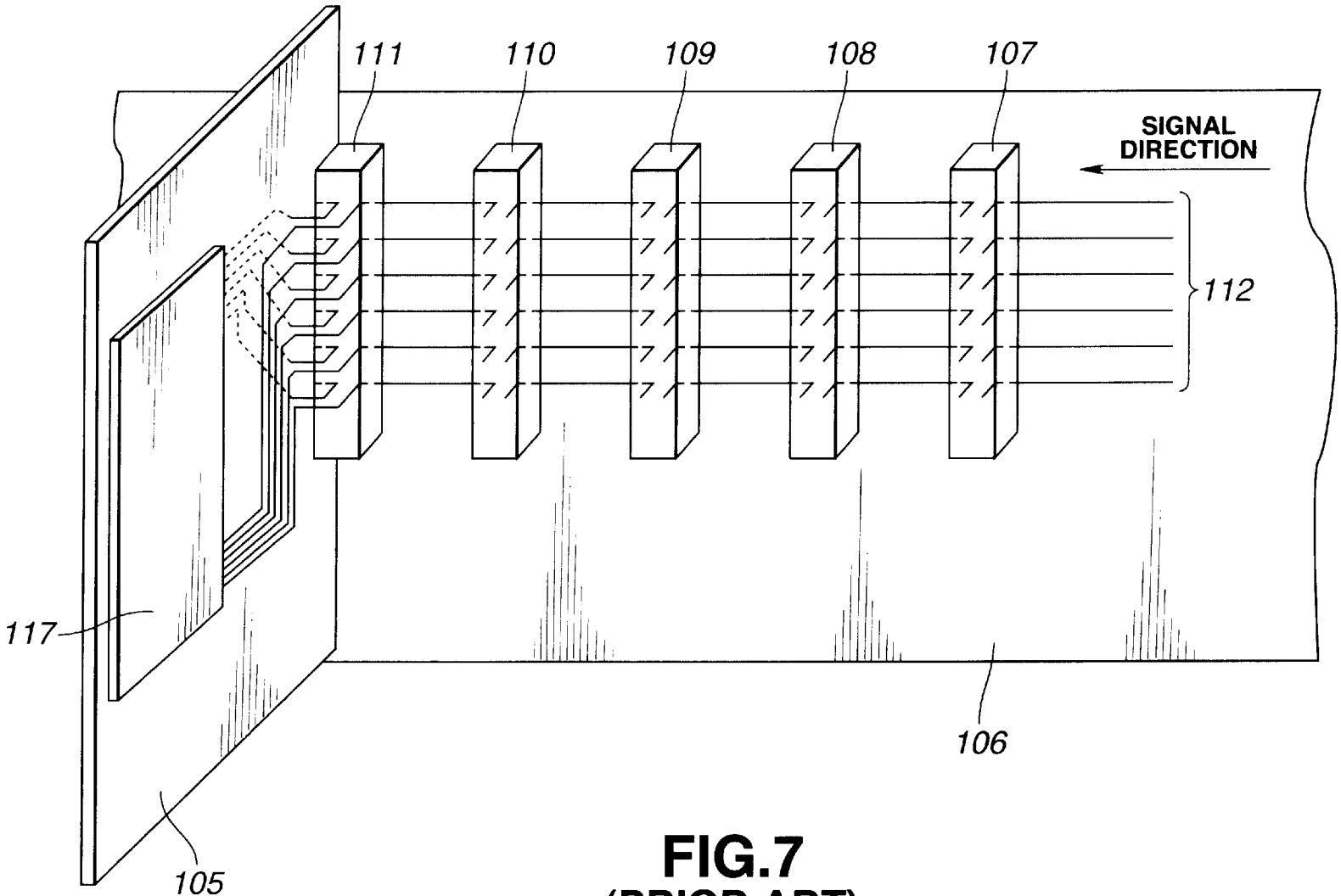
FIG.7 (PRIOR ART)
FIG. 7 shows a state of a conventional connector when no short-circuiting adapter is inserted.
Figure 8:
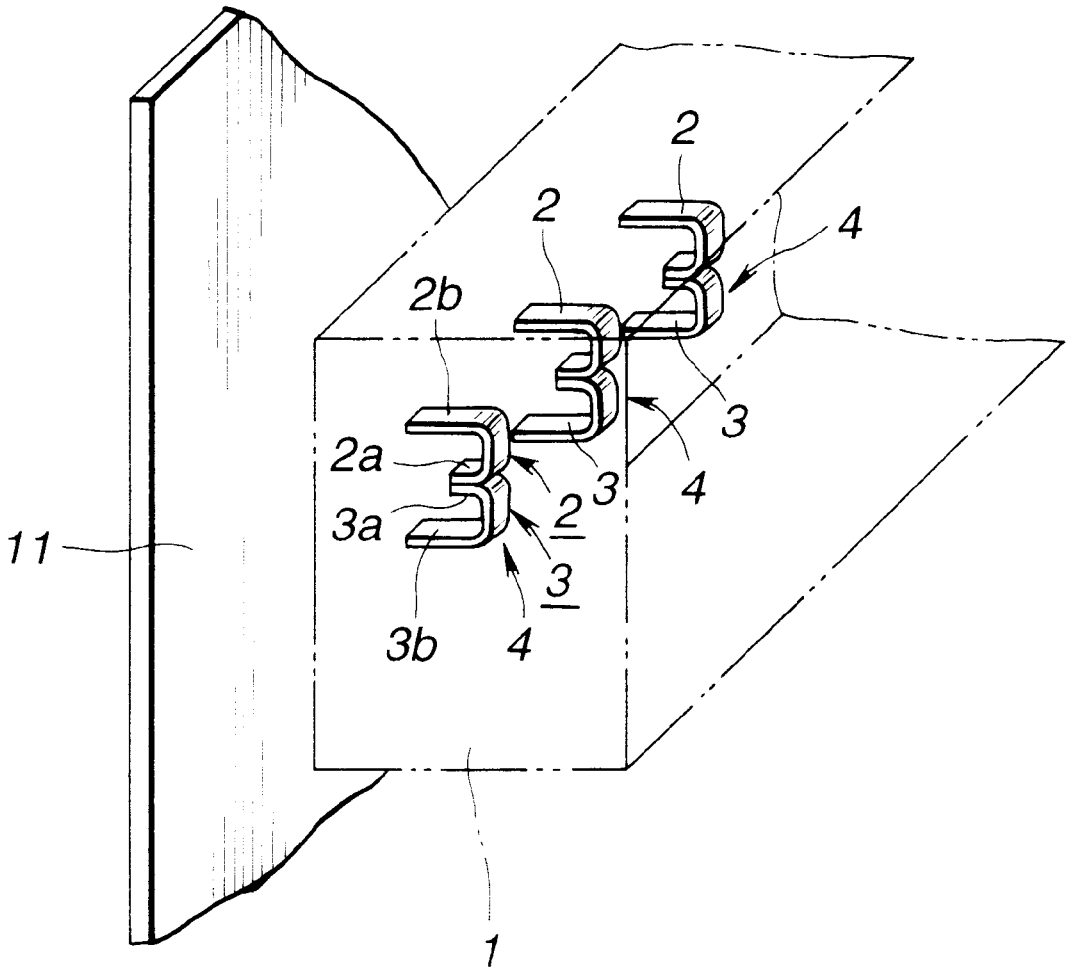
FIG. 8 is a perspective view showing a configuration of a connector according to an embodiment of the present invention.

The aforementioned connector is a connector to which an object apparatus such as an I/O card is guided to be inserted. As shown in FIG. 8, the connector 1 comprises connection means 4 having a first terminal member 2 to be electrically connected to a first connection member serving as an I/O card terminal which will be detailed later and a second terminal member 3 to be electrically connected to a second connection member serving as the aforementioned I/O card terminal which will be detailed later.

The aforementioned first terminal member 2 is constituted by a first contact section 2*a* serving as a contact portion with the second terminal member 3 and the first connection member, and a support section 2*b* for elastically supporting the first contact section 2*a*. Similarly, the second terminal member 3 is constituted by a second contact section 3*a* serving as a contact portion with the first terminal member 2 and the second connection member, and a support section 3*b* for elastically supporting the second contact section 3*a*. The first terminal member 2 and the second terminal member 3 are elastically urged to oppose to each other by the support sections 2*b* and 3*b*, respectively. The first terminal member 2 and the second terminal member 3 are made, for example, from an electrically conductive elastic member.

Here, the fist terminal member and the second terminal member 3 constituting the connection means 4 are arranged to stand on the back plane substrate 11 constituting the back plane, with their support sections 2*b* and 3*b* extending from the back surface of the back plane substrate 11. The extension end is connected to a signal line. Thus, the connection means 4 intervenes the signal line to be connected to the signal line.

The connector 1 comprises a plurality of connection means 4 inserted to be connected to and to intervene a plurality of signal lines constituting the back plane. The plurality of connection means 4 are arranged on the back plane substrate 11 in a line which vertically intersects the elastic urging of the contact position between the first terminal member 2 and the second terminal member 3.

It should be noted that the first connection member and the second connection member are arranged, as will be explained later, on the front and back surfaces of a substrate which is a plate-shaped insulating member so as to oppose to each other, and have one end serving as a contact portion with the aforementioned terminal members and the other end serving for electrical connection between these connection members. Here, a processing circuit and the like are mounted on the substrate, constituting the aforementioned I/O card for example. The connection member has a mounting end which is guided to be inserted into the connector 1.

The connector 1 having the aforementioned configuration, when in a first state as shown in FIG. 8, the first terminal member 2 and the second terminal member 3 are in contact with each other so as to be electrically connected between the first terminal member 2 and the second terminal member 3, forming a so-called short-circuited state.

Moreover, in a second state of the connector, as will be explained later, the first terminal member 2 is mechanically disconnected from the second terminal member 3 by insertion of a substrate such as an I/O card having a first connection member and a second connection member. As a result, the first terminal member 2 is brought into contact with the first connection member, forming an electrical connection between the first terminal member 2 and the first connection member, and the second terminal member 3 is brought into contact with the second connection member, forming an electrical connection between the second terminal member 3 and the second connection member.

For example, the aforementioned connector 1 is formed by a mold member of an approximately box shape.

Figure 9:
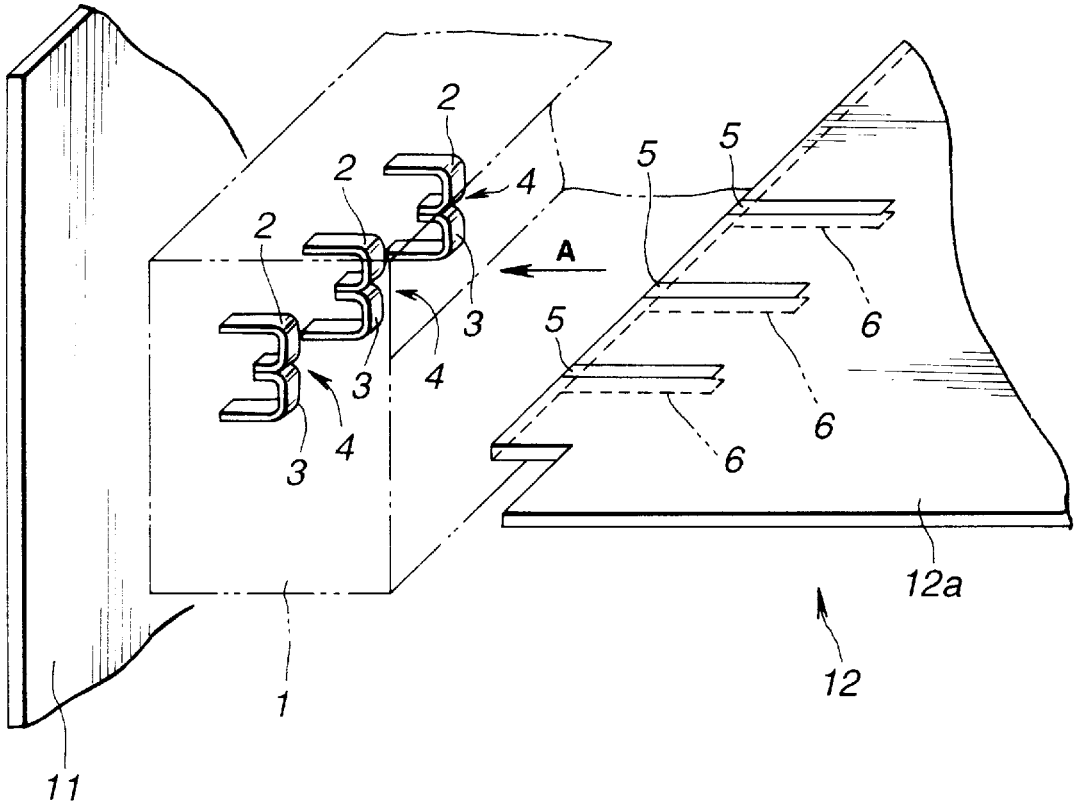
FIG. 9 is a perspective view showing a configuration of the aforementioned connector and an I/O card having contact sections to be inserted into the connector.

FIG. 9 shows how an I/O card as an object apparatus is inserted into the connector 1.

The I/O card 12 to be inserted into the connector 1 is a so-called card edge type having first connection members 5 and second connection members 6 on its front and back surfaces, respectively, so as to form pairs. It should be noted that the first connection members 5 are completely insulated from the second connection members 6 by a substrate body 12*a*.

Moreover, in the I/O card 12, the first connection member 5 and the second connection member 6 are formed, for example, in a plurality of pairs corresponding to the plurality of connection means 4 constituted in the aforementioned connector 1.

This I/O card 12 has a signal pattern wiring serving as a signal processing circuit for processing a signal inputted when inserted to be connected to the connector 1. This I/O card 12 is introduced in a direction indicated by arrow A in the figure so as to be guided to be inserted into the connector 1.

Figure 10:
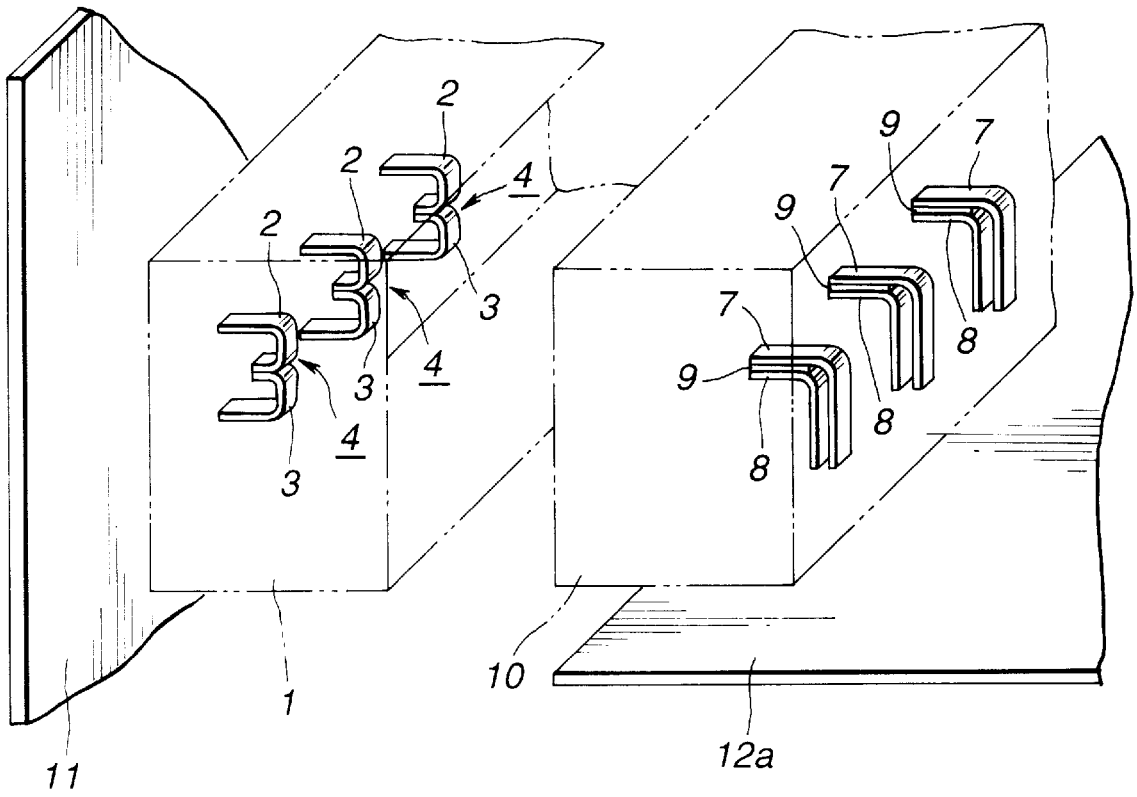
FIG. 10 is a perspective view showing a configuration of the aforementioned connector and an I/O card having another type of contact sections to be inserted into the connector.

Moreover, as shown in FIG. 10, the connection members in the I/O card 12 may be a pair of a first connection member 7 and a second connection member 8, each having one end to oppose each other via an insulator 9 and the other end connected to a processing circuit or the like arranged on a substrate 12*a*. For example, the first connection member 7 and the second connection member 8 are formed as a unitary block of connector 10 by a mold member.

The connector 1 having the aforementioned configuration is in the aforementioned first state when no object apparatus such as I/O card is connected, and the first terminal member 2 has the contact point 2*a* in contact with the contact point 3 of the second terminal member 3, short-circuiting a signal line.

On the other hand, when an object apparatus is mounted, the connector 1 is in the aforementioned second state, enabling to take signals from signal lines to which the respective connection means 4 are inserted to be connected. Simultaneously with this, the first terminal member 2 is mechanically disconnected from the second terminal member 3, thus enabling to cut off electricity. Consequently, when in the second state, the connector 1 can maintain a connection to a signal line via the object apparatus inserted.

Furthermore, in the aforementioned second state, if the object apparatus is removed, the connection means 4 is automatically returned by a spring component of the support section of the terminal members again to the first state, i.e., a short-circuit state.

Accordingly, the connector 1, not depending on attachment/removal of an I/O card, can maintain a signal connection for the position where the connector 1 is inserted/connected.

Next, explanation will be given on a case when a plurality of connectors 1 are inserted/connected to a back plane serving as an internal bus. For example, the back plane having such a configuration can be applied as an internal bus of a data processing apparatus such as a computer. In a data processing apparatus to which the connector 1 is applied, a terminal side of a substrate of an object apparatus such as an I/O card is guided to be inserted into the connection means 4 which intervenes the bus.

Figure 11:
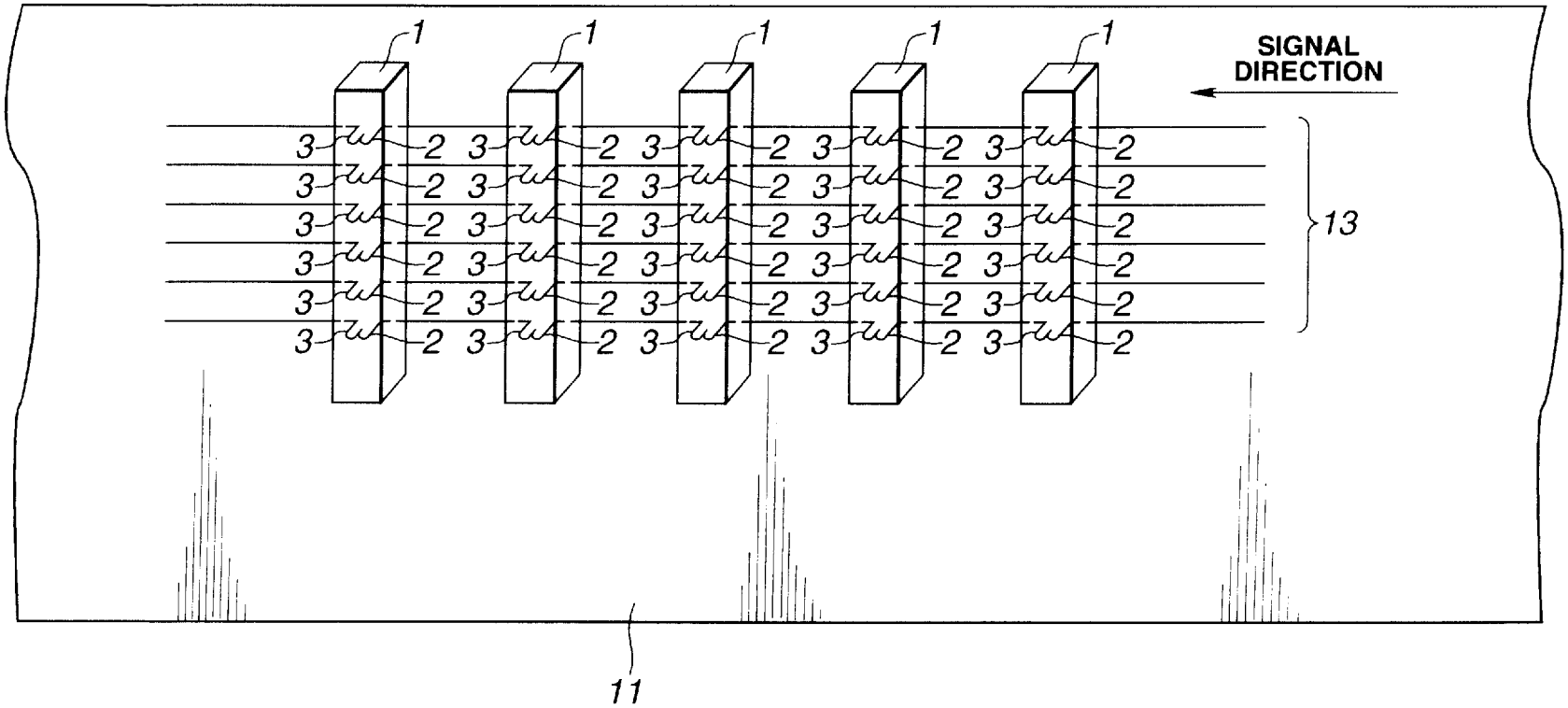
FIG. 11 is a perspective view showing a configuration of a connector constituted on a computer back plane according to an embodiment of the present invention.

FIG. 11 shows a specific configuration of such a case, where, for example, five connectors 1 are connected in series by six signal lines 13. Thus, to each of the signal lines is inserted/connected a corresponding connection means of the connector 1 which intervenes the signal line.

Figure 12:
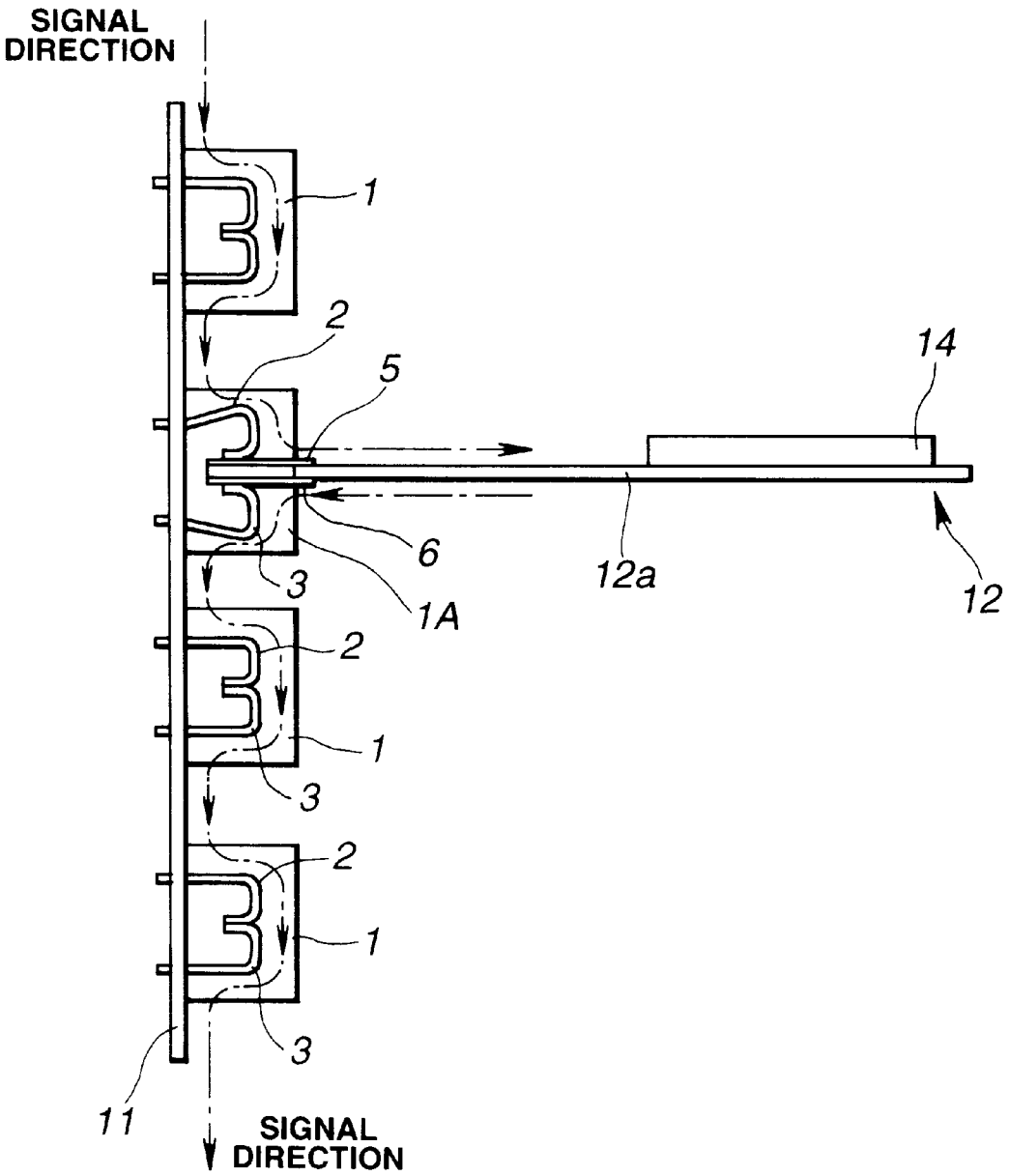
FIG. 12 is a side view showing a state of the aforementioned connector when an I/O card substrate is inserted.

FIG. 12 shows a signal flow in a signal line when an I/O card 12 or the like is guided to be inserted into one connector 1A of a plurality of connectors arranged on a back plane substrate.

As shown in FIG. 12, when the substrate 12*a* of the I/O card 12 is inserted into the connector 1, the first terminal member 2 is mechanically disconnected from the second terminal member 3 so as to cut off a direct electrical connection between the first terminal member 2 and the second terminal member 3. Furthermore, with the insertion of the substrate 12*a*, the first terminal member 2 is brought into contact with the first connection member 5 of the inserted I/O card 12 and the second terminal member 3 is brought into contact with the connection member 6 of the I/O card substrate 12. Thus, an electrical connection is set up between the first terminal member 2 and the first connection member 5 as well as between the second terminal member 3 and the second connection member 6, forming the aforementioned second state.

The aforementioned I/O card 12 connected to the connector 1A is supplied with a signal inputted to signal line 13 of the back plane substrate 12, via the terminal member 2 of the connector 1A. The signal fed to the I/O card 12 via the first terminal member 2 of the connector 1A is processed by a processing circuit 14 provided in the I/O card 12 or directly outputted without being processed via the second connection member 6 to the second terminal member 3 of the connector 1A.

It should be noted that the other connectors 1 having no I/O care is inserted, as has been described above, are in the first state where the first terminal member 2 is short-circuited with the second terminal member 3. Here, the signal inputted to the first terminal member 2 from the signal line is outputted via the second terminal member 3 again to the signal line.

Accordingly, the connector 1 can maintain the electrical connection where the connector 1 is inserted, even when no object apparatus such as an I/O card is inserted. Thus, the short-circuit adapter conventionally used is not required.

That is, by using the connector 1, a data processing apparatus can maintain signal lines constituting an internal bus always in a connected state independently of attachment/removal of a object apparatus to be connected.

For example, a computer or the like as the data processing apparatus is connected to a network in such a manner that a back plane of the computer is connected to the network As has been described above, the computer comprises a connector intervening the signal lines constituting the internal bus so that a terminal side of a substrate of an object apparatus such as an I/O card can be guided to be inserted. The computer having this configuration is connected to the aforementioned network with the insertion of the aforementioned signal line.

When the computer having the aforementioned configuration is connected by way of insertion connection to a network, an object apparatus to be connected to a back plane of the computer constitutes a so-called node in the aforementioned network. For example, in this case, the computer nodes are CPU node, memory node, storage node, other I/O apparatus node, and the like.

Figure 13:
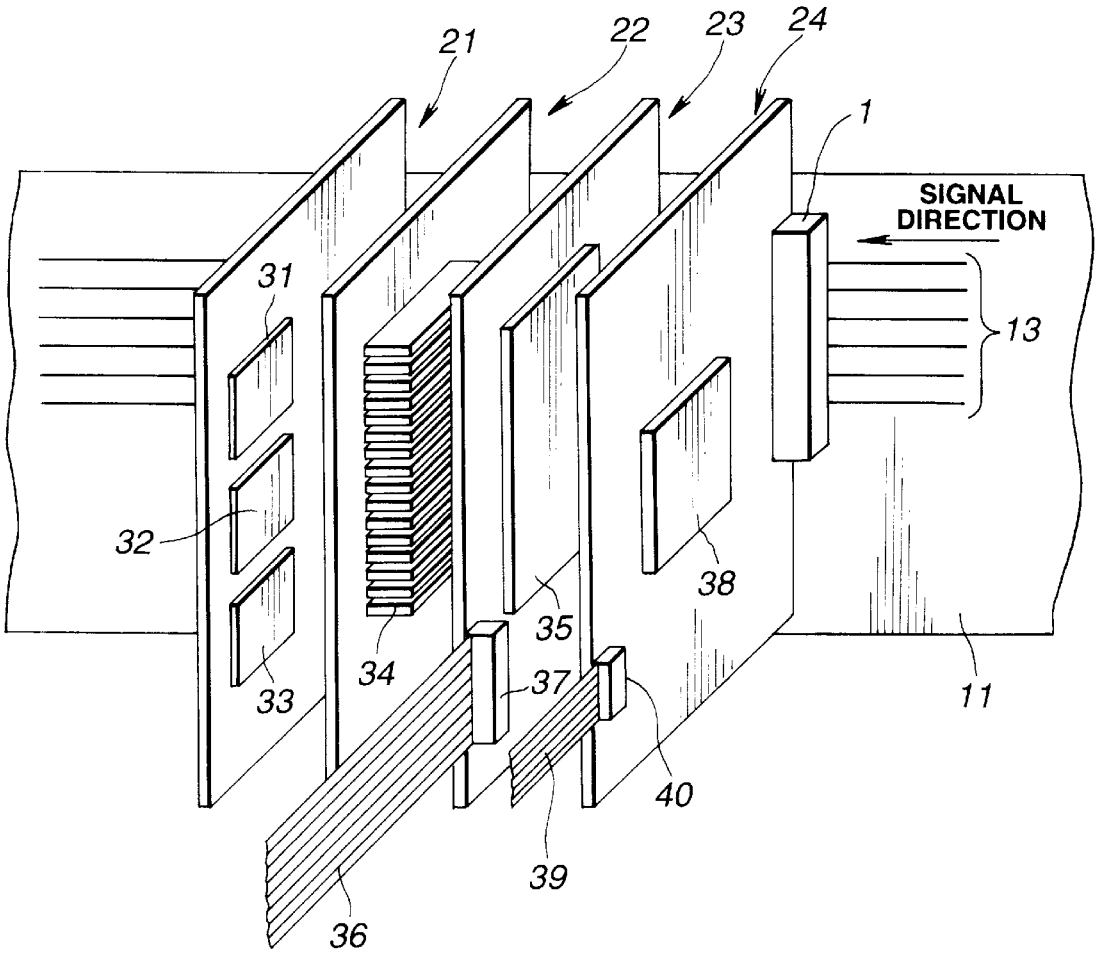
FIG. 13 is a perspective view showing the aforementioned connector constituted on the computer back plane when various nodes are inserted.

For example, as shown in FIG. 13, a computer is constituted by various nodes such as a CPU node 21, a memory node 22, a storage node 23, and an I/O apparatus node 24 which are guided and inserted into the corresponding connectors 1. Here, the connectors 1, similarly as in the aforementioned FIG. 11 and FIG. 12, are inserted and connected to the signal lines 13 so as to be in series connection as a whole, and the input and output of the signal lines 13 are inserted/connected to the network line.

Here, the CPU node 21 comprises a cache 32 and a cache 33. The aforementioned memory node 22 comprises a memory 34. The aforementioned storage node 23 comprises a storage interface circuit 35 and with this storage interface circuit 35, is connected to a storage apparatus such as an HDD via a storage interface connector 37 and a storage interface cable 36.

The aforementioned I/O apparatus node 24 is constituted to as to transmit and receive an information signal corresponding to other I/O apparatus, and comprises an interface circuit 38 for this. With this interface circuit 38, the I/O apparatus node 24 is connected to other I/O apparatus via an interface connector 40 and an interface cable 39.

Figure 14:
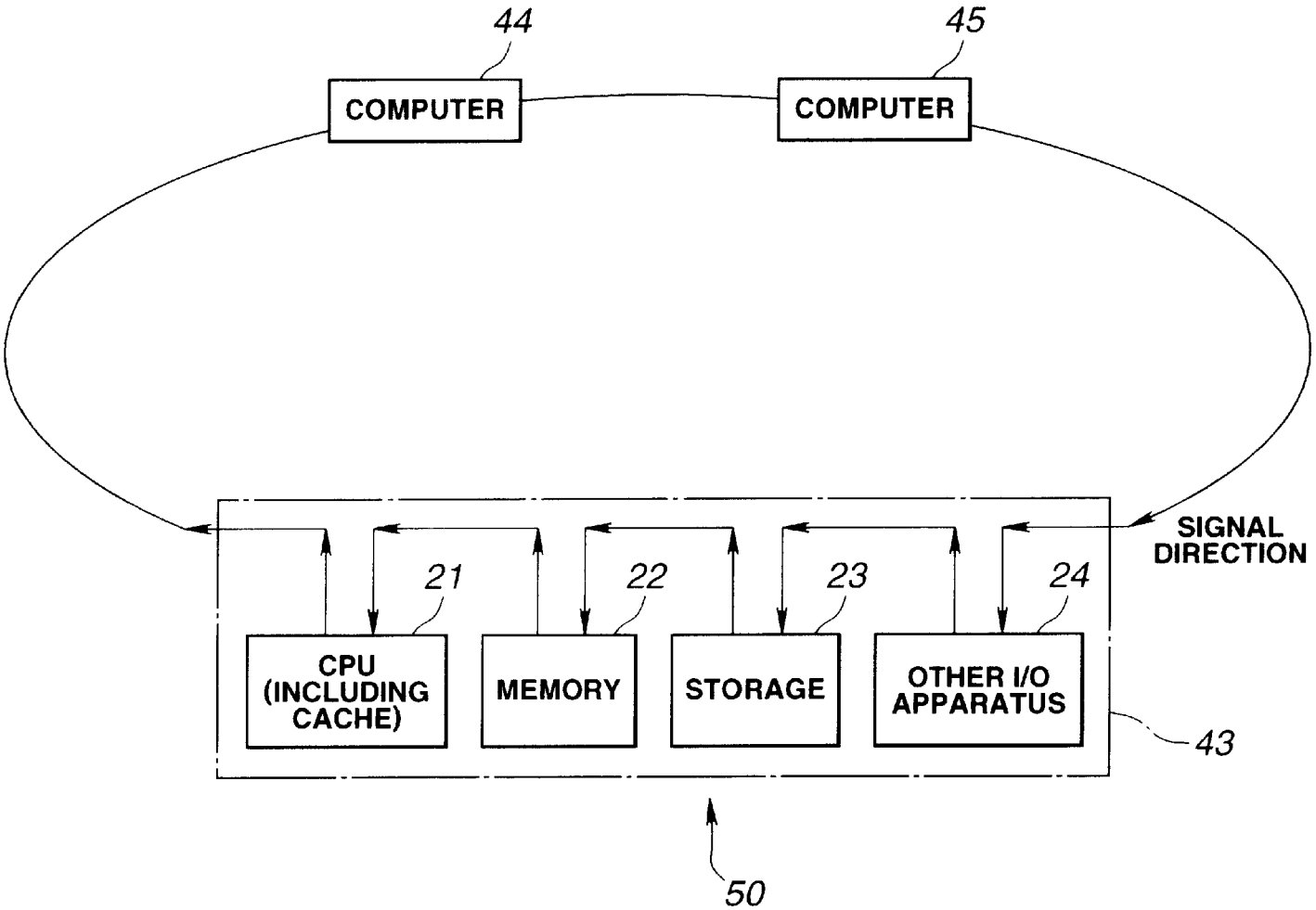
FIG. 14 shows a network system according to an embodiment of the present invention where various nodes are inserted into a connector on a back plane of one of the computers.

FIG. 14 shows the aforementioned computer 43 having a back plane constituted by the aforementioned respective nodes, which computer is inserted to be connected to a network system 50 of a ring topology. Note that besides the computer 43, other computers 44 and 45 are connected to this network system 50.

More specifically, the computer 43 is connected to the network system 50 in such a manner that signal lines having connectors to which various nodes are to be guided to be inserted constitute a part of the network of the ring topology. That is, the computer 43 is connected to the network 50 so that a signal is inputted and outputted in series with respect to the network 50.

As has been described above, this computer 43 is constituted by the CPU node 21, the memory node 22, the storage node 23, and the I/O apparatus node 24 which are inserted and connected to a single back plane.

In the network system 50 having the ring topology configuration, even if any of the CPU node 21, the memory node 22, the storage node 23, and the I/O apparatus node 24 is attached or removed in the computer 43 connected to the network, a signal line connection to this computer 43 can always be maintained. Accordingly, a signal connection in this network system 50 will not be cut off, enabling to maintain a signal connection of a ring shape as a whole. That is, it is possible to insert and remove a node while maintaining the network connection of the ring topology.

For example, if the storage node 23 is removed in the computer 43, the aforementioned connector 1 maintains a signal connection so that the aforementioned network system 50 can maintain the ring connection as a whole.

It should be noted that the connection of the computer itself to the network system having the aforementioned configuration can also be carried out by using he aforementioned connector 1. That is, the connector 1 provided in a connection device inserted and connected to a line of a network system is connected to a computer having a connector block corresponding to this connector 1. Thus, a network system having the ring topology configuration can maintain its ring connection independently of connection of a computer.

Figure 15:
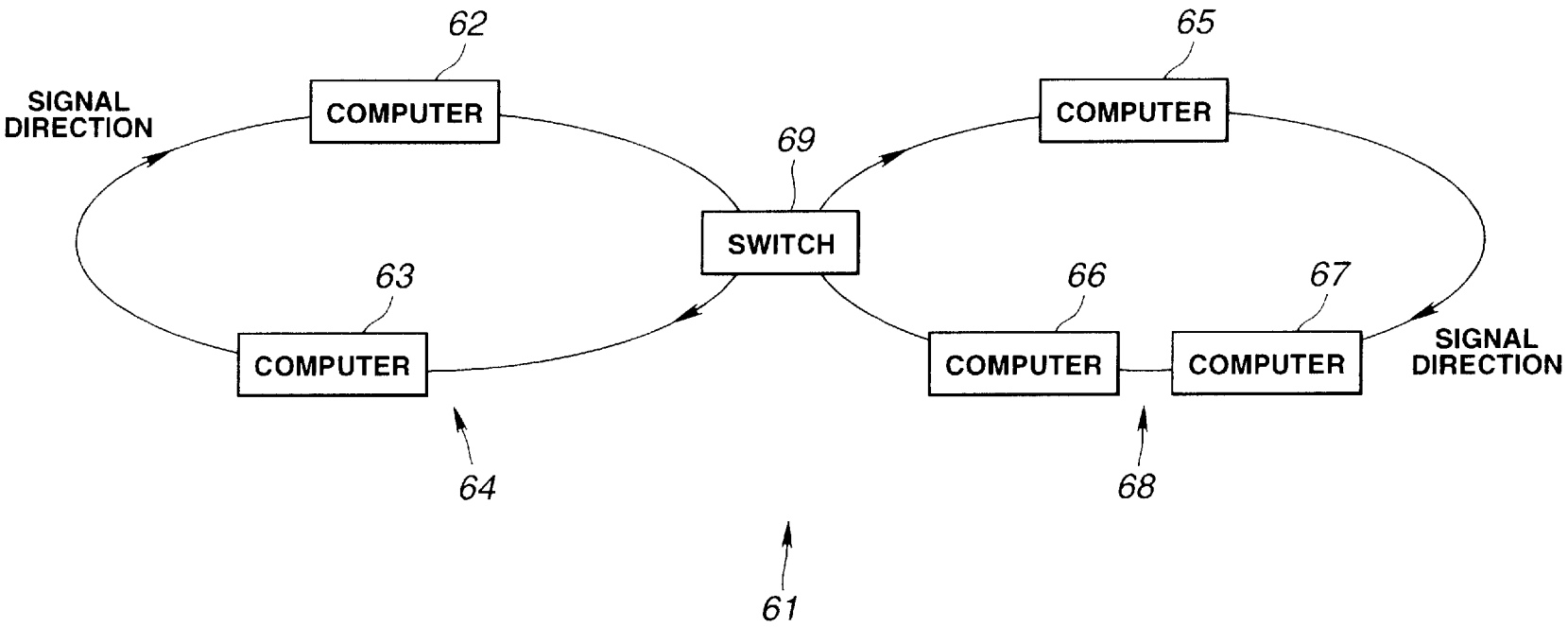
FIG. 15 shows a configuration of a network system constituted by way of a switch topology.

Moreover, a network system can also be constituted by a plurality of network system linked by a switch, so as to have a so-called switch topology configuration. For example, FIG. 15 shows a network system 61 having the switch topology configuration comprising a network 64 constituted by computers 62 and 63 by way of the ring topology and linked with a switch 69 to a network 68 constituted by computers 65, 66, and 67 by way of the ring topology.

In this network system 61 having the switch topology configuration, if each of the computers 62, 63, 65, 66, and 67 has its back plane constituted by the aforementioned connectors 1, an attachment or removal of a node from the connectors 1 will not affect a signal line connection in the computer.

Thus, the network system 61 can maintain its network connection of the switch topology while various nodes are inserted or removed.

It should be noted that the aforementioned connector 1 is not to be limited to the aforementioned configuration but can determine its configuration according to a substrate configuration of an apparatus or an object apparatus to be connected to this connector.

What is claimed is:

1. A network apparatus comprising:

a plurality of nodes connected to one another in a ring topology through a common signal line, each of said nodes comprising a computer including an input for receiving a signal from said common signal line, an output for outputting said signal to said common signal line, and one or more connectors adapted to receive a terminal side of an object to be inserted into said connector, each of said connectors including a first terminal member to be electrically connected to a first connection member provided at said terminal side of said object and a second terminal member to be electrically connected to a second connection member provided at said terminal side of said object, wherein in a first state, said object is removed from said connector and said first terminal member is in contact with said second terminal member to establish an electrical connection there between such that all of said nodes remain connected to one another upon removal of said object, and in a second state, said object is inserted into said connector, and said first terminal member is mechanically disconnected from said second terminal member, said first terminal member is brought into electrical contact with said first connection member, and said second terminal member is brought into electrical contact with said second connection member, such that all of said nodes remain connected to one another upon insertion of said object.

2. A network apparatus as claimed in claim 1, wherein said first connection member and said second connection member are arranged on a front and back surface of a plate-shaped insulating member so as to oppose to each other and each having one end serving as a contact portion with said terminal members and the other end electrically connected to each other.

3. A network apparatus as claimed in claim 1, wherein said first terminal member consists of a first contact section serving as a contact portion with said second terminal member and said first connection member, and a support elastically supporting said first contact section, said second terminal member consists of a second contact section serving as a contact portion with said first terminal member and said second connection member, and support means for elastically supporting said second contact section, and said first terminal member and said second terminal member have said contact sections urged to oppose to each other by said support.

4. A network apparatus as claimed in claim 3, wherein said common signal line comprises a plurality of signal lines and said connector comprises a plurality of connectors to be inserted to be connected, so as to intervene said signal lines, and said connectors being arranged in such a manner than in said first state, said respective first terminal members and corresponding second terminal members are aligned on a line which vertically intersects a direction of said urging.

* * * * *

UNITED STATES PATENT AND TRADEMARK OFFICE

CERTIFICATE OF CORRECTION

PATENT NO. : 6,244,881 B1
DATED : June 12, 2001
INVENTOR(S) : Hara, Hideki

It is certified that error appears in the above-identified patent and that said Letters Patent is hereby corrected as shown below:

Column 1,
Line 9, "equipments" should read -- equipment --.
Line 15, "equipments are" should read -- equipment is --.
Line 19, "equipments" (second occurrence) should read -- equipment --.
Line 30, "vgia" should read -- via --.
Line 33, "process" should read -- processes --.
Line 45, "are" should read -- is --.
Line 48, after "104" insert -- and --.

Column 2,
Line 15, immediately after "112" insert -- . --

Column 3,
Line 2, "at" should read -- a --.

Column 6,
Line 21, after "as" insert -- an --.
Line 27, after "enabling" insert -- it --.
Line 31, "to cut off" should read -- the cutting off of --.

UNITED STATES PATENT AND TRADEMARK OFFICE

CERTIFICATE OF CORRECTION

PATENT NO. : 6,244,881 B1
DATED : June 12, 2001
INVENTOR(S) : Hara, Hideki

It is certified that error appears in the above-identified patent and that said Letters Patent is hereby corrected as shown below:

Column 7,
Line 20, "care is" should read -- card 12 --.
Line 37, after "network" insert -- . --.
Line 63, after "memory 34." start a new paragraph.

Signed and Sealed this

Second Day of April, 2002

*Attest:*

*Attesting Officer*

JAMES E. ROGAN
*Director of the United States Patent and Trademark Office*